United States Patent [19]

Cradeur et al.

[11] 3,938,535

[45] Feb. 17, 1976

[54] TUBE CLEANING DEVICE

[75] Inventors: Robert R. Cradeur, Sulphur; John E. Cardone, Lake Charles, both of La.

[73] Assignee: Browning-Ferris Industries, Inc., Houston, Tex.

[22] Filed: June 10, 1974

[21] Appl. No.: 477,848

Related U.S. Application Data

[60] Division of Ser. No. 278,565, Aug. 7, 1972.

[52] U.S. Cl. ..... 134/167 C; 134/172

[51] Int. Cl.[2] ..... B08B 3/02; B08B 9/02

[58] Field of Search ..... 134/22 C, 24, 46, 57 R, 134/166 C, 167 C, 168 C, 169 C, 172; 15/104.1 R, 104.16, 317

[56] References Cited

UNITED STATES PATENTS

| | | | |
|---|---|---|---|
| 3,184,774 | 5/1965 | Burch | 15/317 |
| 3,216,046 | 11/1965 | Chappell | 15/317 |
| 3,389,713 | 6/1968 | Pittman | 134/167 C |
| 3,439,376 | 4/1969 | Nelson et al. | 15/317 |
| 3,448,477 | 6/1969 | Ricordeau et al. | 15/104.1 R |

*Primary Examiner*—Robert L. Bleutge
*Attorney, Agent, or Firm*—Pravel & Wilson

[57] ABSTRACT

A tube cleaning device including a water lance and a movable carriage with a driving mechanism for extending and retracting the lance, lance guides and a device for supplying water under pressure to the lance; the driving mechanism being located close to the lance tip when the lance is in its retracted position.

4 Claims, 19 Drawing Figures

Fig. 5
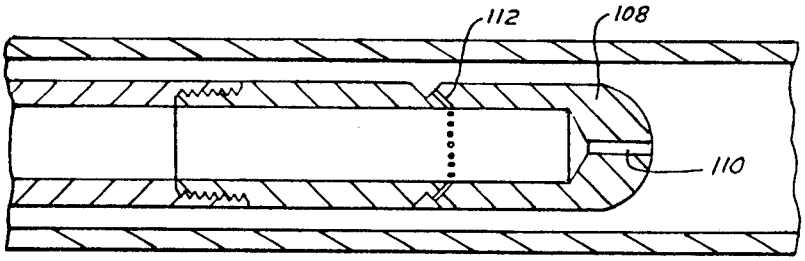
Fig. 6
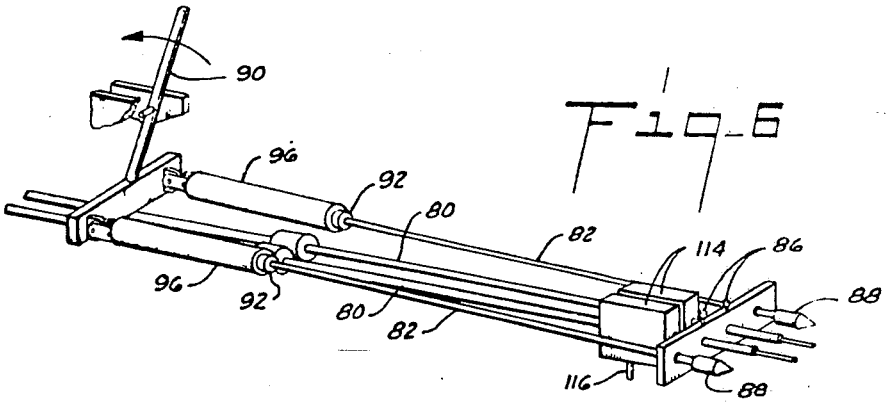
Fig. 7
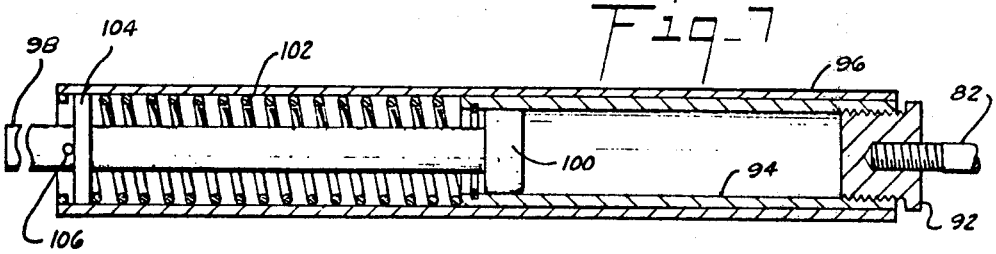
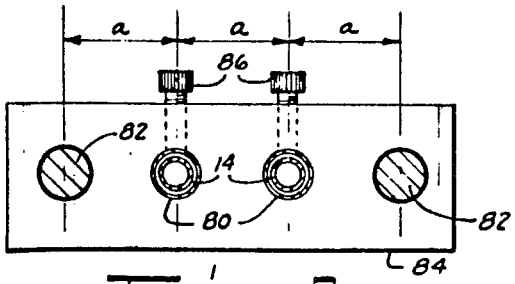
Fig. 8

TUBE CLEANING DEVICE

CROSS REFERENCE TO RELATED APPLICATIONS

This application is a division of our prior co-pending application Ser. No. 278,565 filed Aug. 7, 1972, which is a continuation-in-part of and co-pended with, prior application Ser. No. 116,121, filed Feb. 17, 1971, now abandoned.

BACKGROUND OF THE INVENTION

The interior of tubes which become fouled with deposits are commonly cleaned by inserting lances or pipes with spray tips thereon into the fouled tubes and applying water under pressure to the lance so that the water is jetted from the tip with sufficient velocity to clean the deposits from the interior of the tubes. Prior tube cleaning devices have been very cumbersome so that the tubes to be cleaned, such as, heat exchanger tubes, are brought to the device rather than bringing the device to the tubes. Further, the point of application of force to extend the lances has been at the end of the lance opposite its spray tip. Because the lances are usually relatively small in diameter and long, considerable support is required to avoid buckling of the lances as they are driven into the tubes.

SUMMARY

The present invention relates to an improved water jet type tube cleaning device.

An object of the present invention is to provide an improved tube cleaning device with a positioning of the lance drive to minimize buckling of the lance.

Another object of the present invention is to provide an improved tube cleaning device for cleaning tubes in a plant without having to remove the tube from their installed position in the plant.

A further object is to provide an improved tube cleaning device with lances which are easily and quickly inserted within the tubes of a tube and shell type heat exchanger to clean the interior of the tubes quickly and simply.

Still another object is to provide an improved tube cleaning device with lances that are simply guided with the proper spacing to enter the tubes to be cleaned.

Still a further object is to provide an improved tube cleaning device having a water lance to which sufficient axial force may be applied to force the lance through blocked tubes.

BRIEF DESCRIPTION OF THE DRAWINGS

These and other objects and advantages are hereinafter set forth and explained in the description of the structure shown in the drawings wherein:

FIG. 5 is a partial sectional view illustrating the spray tip of a lance within a tube.

FIG. 6 is a perspective view of the lance positioning and guiding means.

FIG. 7 is a sectional view of the spring loading structure of the lance positioning means.

FIG. 8 is an elevation view of the lance spacing plate.

DESCRIPTION OF THE PREFERRED EMBODIMENTS

Figure 1:
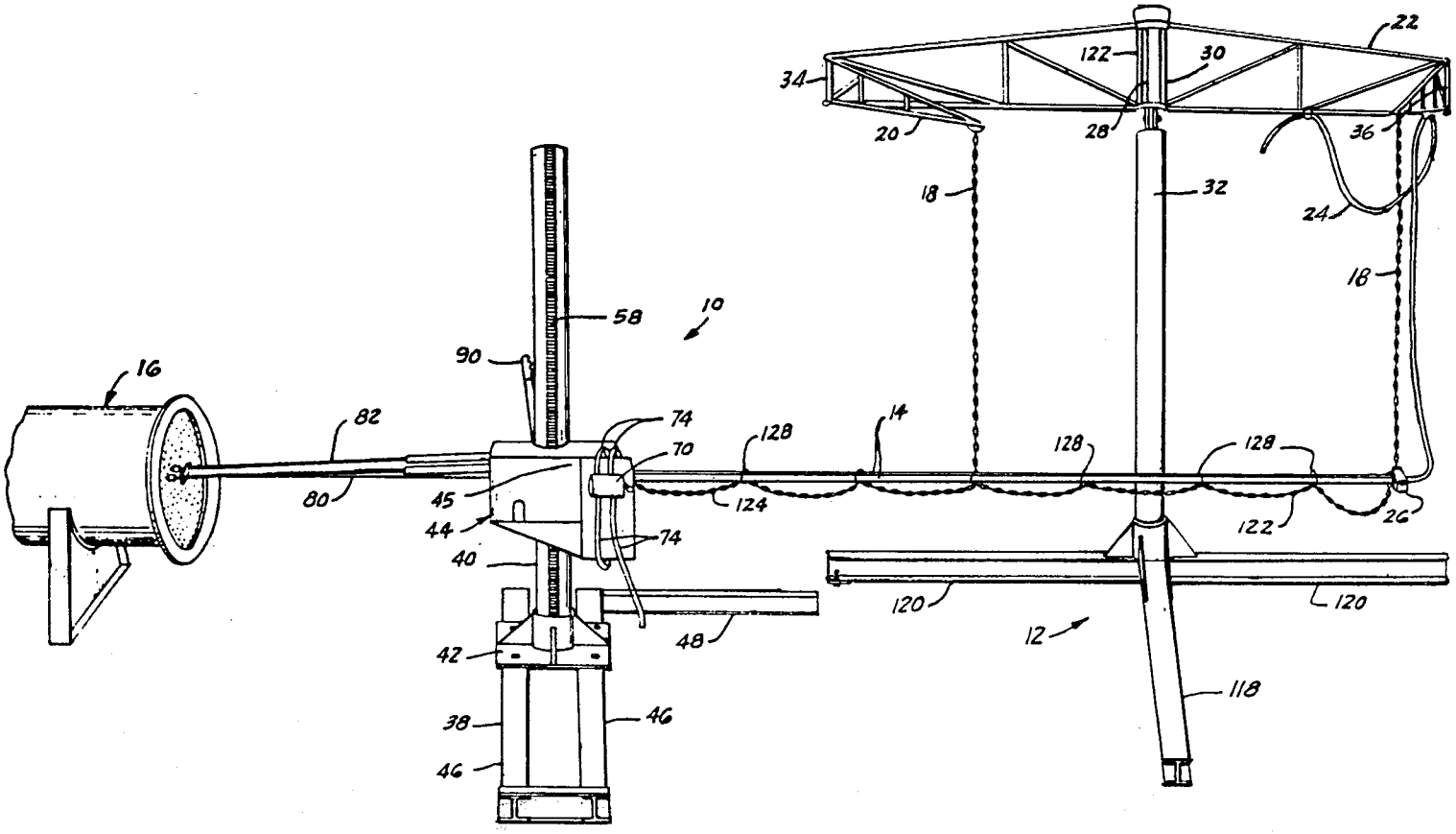
FIG. 1 is a perspective view of the improved tube cleaning device of the present invention in position for cleaning the tubes of a heat exchanger.

The tube cleaning device of the present invention includes the lance driving and guiding device 10, the lance supporting device 12 and water means which delivers water to the water blasting spray lance 14. In FIG. 1, the complete portable tube cleaning device is shown positioned for cleaning the tube and shell heat exchanger 16. The function of the cleaning device is to remove dirt and deposits from the interior of the tubes by inserting the lances 14 into the tubes of the exchanger 16 and delivering high velocity water jet sprays to the interior of the tubes as the lances 14 are moved into and retracted from the tubes. The lances 14 are shown in their retracted position in FIG. 1 with their outer or manifold end being supported by the chains 18 from the arms 20 and 22 of the support device 12. The lances are supplied with water under high pressure by hose 24 to the manifold 26 on the outer end of the lances 14. The hose 24 is supported on the second arm 22 of the support device 12.

Figure 11:
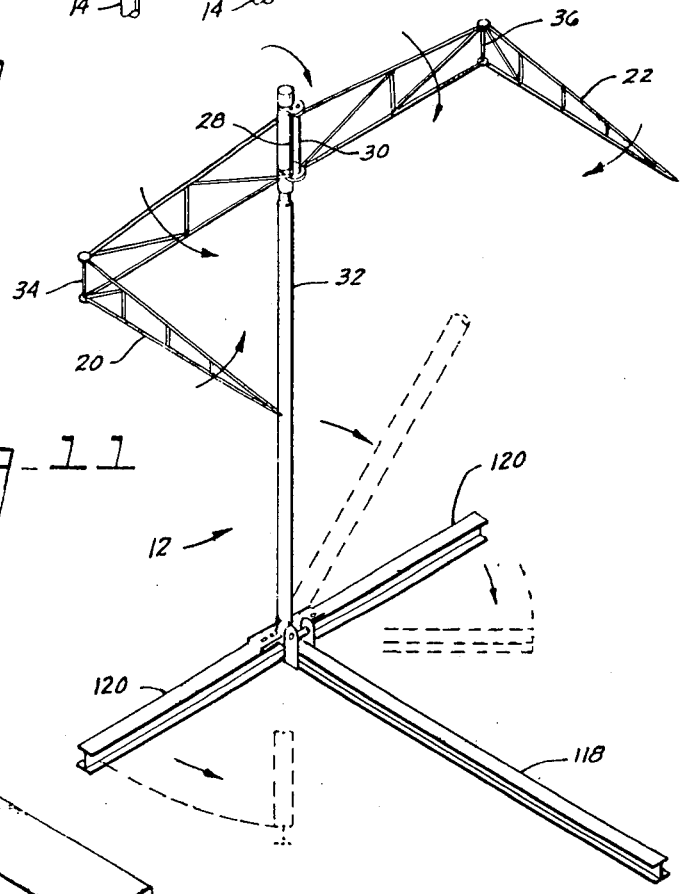
FIG. 11 is a perspective view of the lance and hose support to illustrate the manner in which it may be collapsed for moving.

The arms 20 and 22 of the support device 12 each have a double pivot mounting about the pins 28 and 30 which connect the arms to the column 32 and about the pins 34 and 36 which are positioned at an intermediate point on the arms as shown in FIGS. 1 and 11. This double pivot mounting allows the chain 18 and hose 24 to move with the lances 14 as they are driven into the tubes of the heat exchanger 16 providing support for and high pressure water to the lances.

The lance driving and guiding device 10 includes the base 38, the column 40 supported by the horizontal carriage 42 on base 38 and the vertical carriage 44. The base 38 includes the parallel members 46 and the leg 48 which is pivotally mounted to members 46 and extends rearwardly (away from exchanger 16) therefrom. The members 46 provide the ways for the rollers 50 on carriage 42 so that carriage 42 is movable along the length of the members 46.

The vertical carriage 44 is movable vertically on the column 40 by rotation of crank 52 which drives the gear 54 by connection through the gear box 56 and the gear 54 being in engagement with the rack 58 on the side column 40 determines the position of carriage 44.

The lance driving means is supported on the carriage 44 under the cover 45 and includes the driving roll 60 driven by suitable means as hereinafter described and the idler roll 62. As shown, rolls 60 and 62 are grooved to receive the lances 14 between them. The idler roll 62 exerts a force toward the driving roll 60 to assure driving engagement with lances 14. This force is controlled by rotating the screw 64 to preset the desired force exerted on roll 62 by the spring 66. The air motor 68 which is controlled by valve 70 connects through the gear box 72 to provide the driving means for the driving roll 60. The motor 68 is reversible so that the lances 14 may be positively driven axially in either direction. Air is supplied to valve 70 and motor 68 through the hoses 74.

Figure 2:
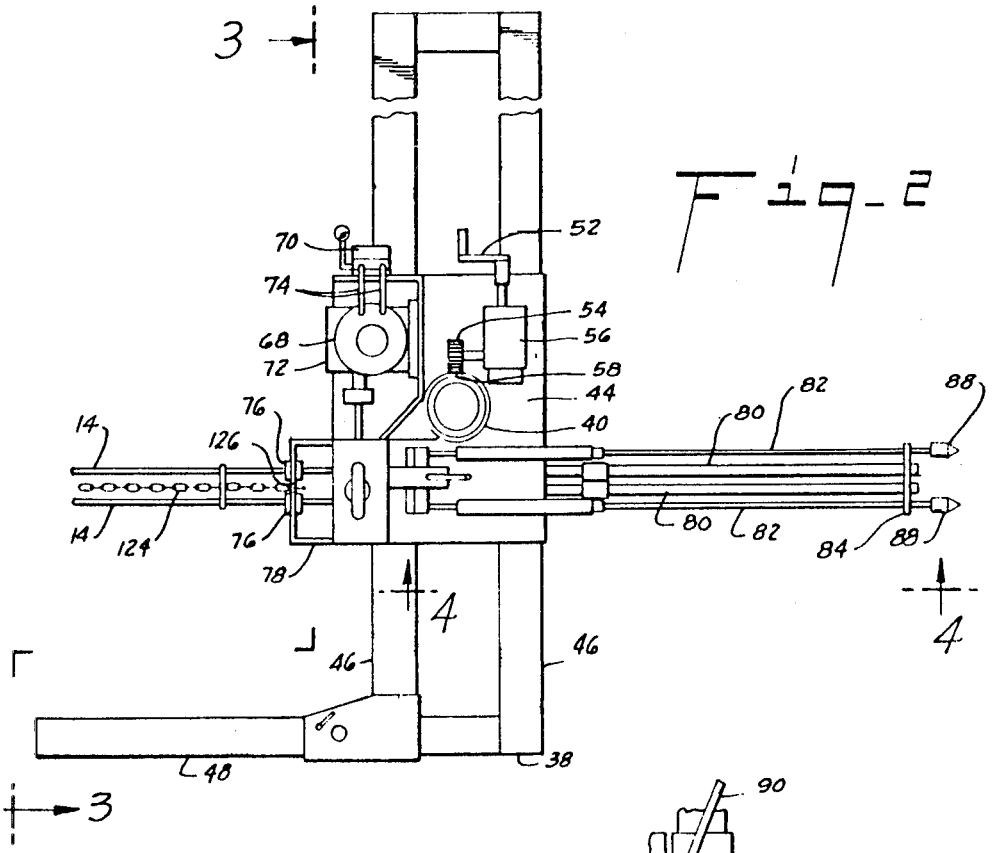
FIG. 2 is a plan view of the lance drive and guiding structure with the carriage cover removed.
Figure 3:
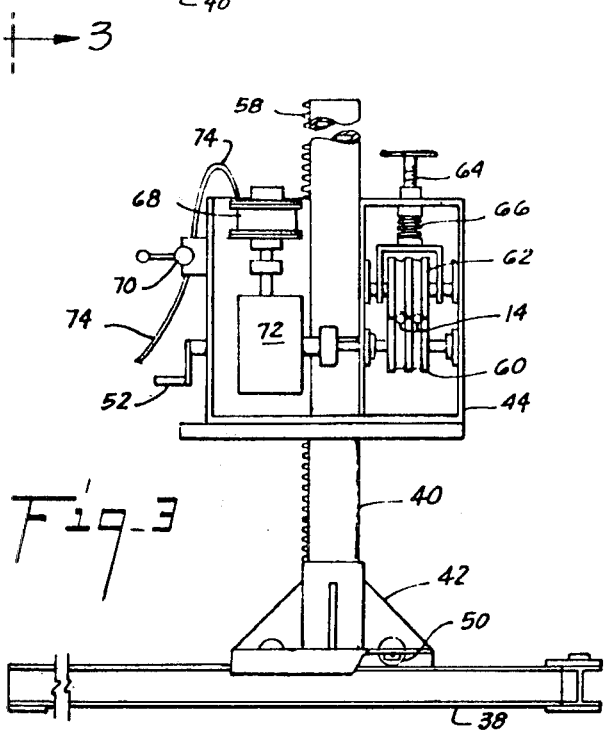
FIG. 3 is an elevation view taken along line 3—3 in FIG. 2 to illustrate the position of the lance driving means.
Figure 4:
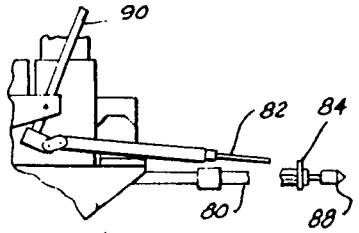
FIG. 4 is a partial elevation view taken along line 4—4 in FIG. 2 to illustrate the position of the lance driving means.

The lances 14 as best shown in FIG. 2 extend through the bushings 76 mounted in the bracket 78 and into engagement in the grooves of the rolls 60 and 62. The guiding and positioning means receive the lances 14 on the opposite side of the rolls 60 and 62 and guide the lances 14 into the interior of the tubes to be cleaned. The guiding and positioning means includes a means for presetting the spacing of the lances to the tube spacing of the heat exchanger to be cleaned. Also, the guiding and positioning means assures that the lance guiding means are in alignment with the tubes before the lances are extended.

Figure 9:
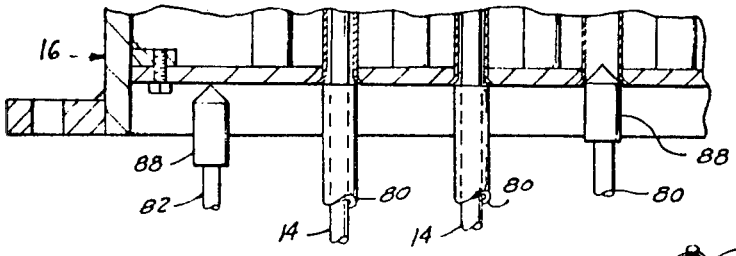
FIG. 9 is a partial sectional view of the lances being guided into tubes of a heat exchanger to show the function of the lance positioning means and the lance spacing plate.

The lance guiding and positioning means includes the guide tubes 80 through which the lances 14 extend and the extendable arms 82 positioned on either side of the guide tubes 80. The lance spacing plate 84 is secured by screws 86 to tubes 80 and the arms 82 are slidable therethrough. The lance spacing plate 84 defines the four holes through which the tubes 80 and the arm 82 extend and the center-to-center distances, *a* in FIG. 8, are all equal and the same as the tube spacing of the tubes to be cleaned. To change the spacing of the lances 14 and the positioning arms 82, the screws 86 which lock the plate 84 on the tubes 80 are released and a new plate 84 having desired spacing is installed on tubes 80 and arms 82. The tapered indexing tips 88 are secured to the ends of arms 82. The tips 88 by being tapered function to locate the guide 80 in alignment with tubes to be cleaned by entering an adjacent tube as best shown in FIG. 9. The arms 82 are actuated to extended position by the lever 90 so that the tips project beyond the end of the guide tubes 80. Also, the arms 82 are springloaded so that one may be extended while the other is retracted to align the lances with the outer two tubes in a row as shown in FIG. 9.

The spring loading structure for the arms 82 is shown in FIG. 7. This structure includes the bushing 92 threaded on the arm 82 and secured in the sleeve 94 which extends a portion of the way through the interior of the tubular mandrel 96. The rod 98 extends into the opposite end of the mandrel and terminates in the plug 100 within sleeve 94. The spring 102 surrounds rod 98 and engages the inner end of sleeve 94 and the washer 104 which is held on rod 98 by the pin 106. Thus, as level 90 is moved to the rear, the arm 82 are moved forward. If one or both of the indexing tips 88 engage the tube sheet rather than within one of the tubes, the rod 98 moves forward within the tubular mandrel 96 and sleeve 94, compressing spring 102 without damaging the tips 88 or the tube sheet of the heat exchanger 16.

Figure 10:
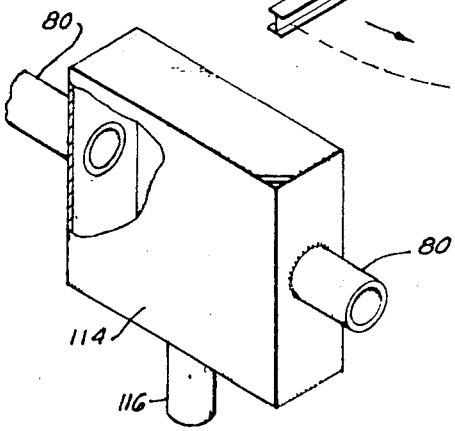
FIG. 10 is a partial perspective view of the lance guiding means to show the spray containing chamber.

The spray tips 108 on the lances are shown in FIG. 5. They thread into the forward end of the lances 14 and are provided with the forward opening 110 to direct a high velocity water jet axially in the tube and the side openings 112 to direct high velocity water jets outward and to the rear. These high velocity jets are designed to perform a maximum amount of cleaning of the deposits from the interior of the tubes. When the tube cleaning device is in operation, it is generally preferred to keep the water flowing from the jets but because of the rearwardly directed openings, the operator and equipment are generally sprayed thoroughly unless some provision is made to dissipate the spray jets as the lances are removed from, and inserted into the next tubes to be cleaned. Wear the ends of each of the tubes 80, box structure 114 is secured in the tubes 80 as best seen in FIG. 10. Each of the box structures 114 has a drain tube 116 extending from the lower side thereof so that when the spray tips 108 are withdrawn into the tubes 80, the water from the spray out the side openings 112 collects in the box 114 and drains out through the drain tube 116. Thus, the box structure 114 functions as a chamber for containing and dissipating the high velocity water jets when the lance tips 108 are not within the tubes being cleaned.

The lance and hose support 12 is made to be collapsible as shown in FIG. 11 so that it may be easily moved from one location to another. Support 12 includes the base leg 118, the side legs 120 which are pivotally secured to leg 118, the column 32 which is pivotally secured to leg 118, and the arms 20 and 22 which extend from the section 122 which is pivotally mounted on the top of column 32. With all of these pivotal connections, the support 12 folds into a small bundle of substantially parallel members and by using aluminum structural members, the bundle is sufficiently light so that it may be carried by two men.

In operation, the lance driving and guiding device 10 is assembled in position for driving the lances 14 into the tubes of heat exchanger 16. The support device 12 is erected in its desired position in relation to the device 10. A supply of air is provided to the air hoses 74 so that the lances may be inserted through the bushings and are driven by the roll 60 into the tubes 80. The lances 14 are supported by the chains 18 as they are inserted. When the lances 14 have been moved into tubes 80 a preselected distance so that their spray tips 108 are still within tubes 80, the chain 124 is tightened and secured to the slot 126 in bracket 78. The chain 124 is also secured to the sliding double loops 128, which surrounds the lances 14 and to the manifold 26. Thus, this chain 124 provides a stop to the retraction of the lances 14. This stop prevents the lances 14 from being completely withdrawn, from the tubes 80.

With the lances 14 installed the water under pressure supplied to the lances 14 through the hose 24 and the manifold 26, the carriage 44 is adjusted vertically and the carriage 42 is adjusted transversly so that the indexing tips 88 on arms 82 which have been extended by actuation of level 90 engage the tubes in heat exchanger 16 to position guide tubes 80 in alignment with the tubes to be cleaned. The valve 70 is actuated to drive the lances 14 into the tubes. When the lances 14 have passed to the end of the tubes of heat exchanger 16, the valve 70 is reversed to retract the lances 14. The carriages 42 and 44 are then moved as required to position the lances 14 in alignment with the next tubes to be cleaned.

When the tubes of heat exchanger 16 have all been cleaned, the hoses 74 and 24 are disconnected from the supply of air and water, the chain 124 is removed from the slot 126 and the lances 14 are completely removed from the driving and guiding device 10 and disconnected from the chain 18. The support device 12 is folded for moving to the next location where the tube cleaning device is to be used. The driving and guiding device may be disassembled by lowering carriage 44 and then jacking column 40 out of engagement with carriage 42. Leg 48 is folded against the members 46 and the device 10 may be moved as three separate pieces, the column 40, the carriage 44 and the carriage 42 and its ways. When moved to the next location, the device 10 is easily reassembled. In the event a longer column 40 is needed, a column having two sections with a suitable joint such as a pin and box joint therebetween may be used to allow the carriage 44 to be positioned higher. In such instances, the length of chains 18 should be adjusted to provide proper support for the lances.

Figure 12:
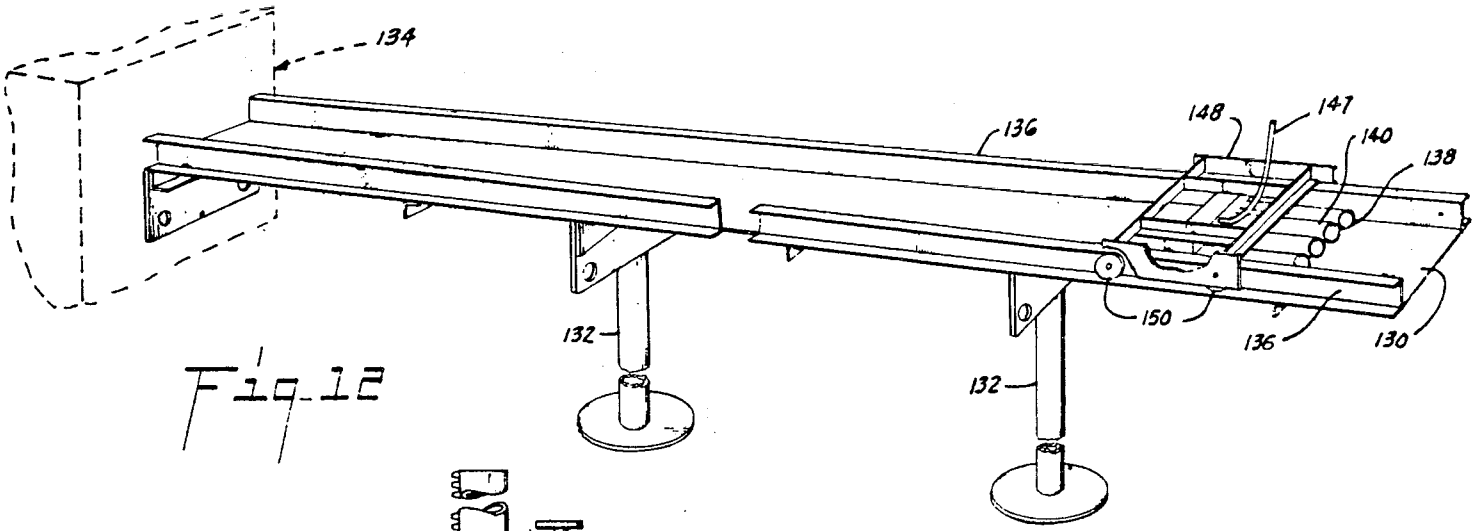
FIG. 12 is a partial perspective view illustrating a modified form of tube cleaning device of the present invention illustrating another form of support for the outer ends of the lances.
Figure 13:
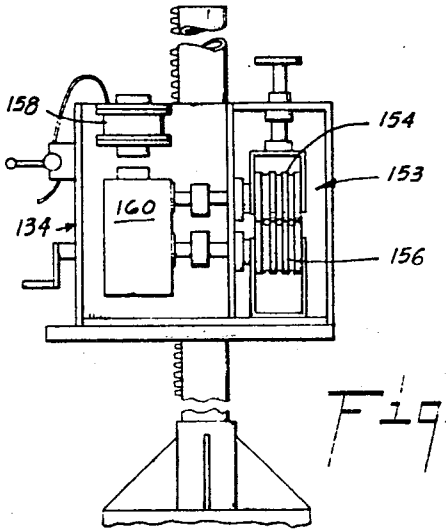
FIG. 13 is an elevation view of a modified form of lance drive in which both rolls are powered.
Figure 14:
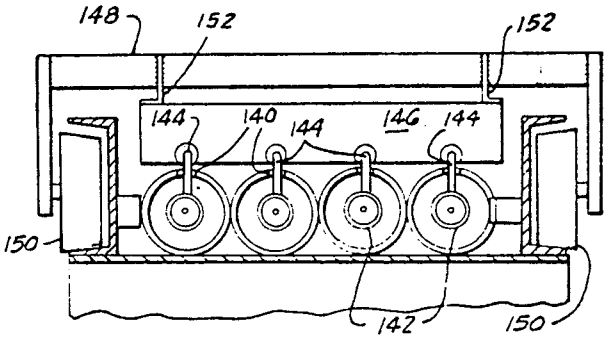
FIG. 14 is an end view of the lances to show the modified form of lance manifold block.

The tube cleaning device illustrated in FIGS. 12, 13 and 14 is similar to the device previously described except that it is provided with a more uniform support for the lances along their entire length and also with dual driving rolls as distinguished from the one driving and one idling rolls previously described.

The improved lance support means are shown in FIG. 12 and 14 and include a tray 130 supported on standards 132 and from the drive unit 134 as shown and having the channels 136 secured to the outer edges of the troy 130. The channels 136 are positioned with their legs extending outwardly from tray 130. A plurality of hollow members, such as tubes 138 each having a longitudinal slot 140 extending along its length at the upper portion thereof are positioned on the tray 130. The lances 142 are adapted to slide through the tubes 138 and the slots 140 in each tube 138 are provided to allow the duct 144 to slide therein. Ducts 144 connect between each of the lances 142 and the manifold block 146 to deliver water to the lances 142 from the hose 147.

In order to minimize the resistance to movement of the lances 142, the manifold block 146 is supported by the carriage 148. The carriage 148 has wheels 150 which engage in the channels 136 and has structure 152 connecting to the manifold block 146. The carriage 148 thus provides a rolling support for the manifold block 146 and the ends of the lances to which the block connects.

With this type of lance support, even extremely long lances will be supported against bending when a force is applied at one end tending to move the lance in a direction toward its other end. It should be noted that as shown the slots 140 in the tubes 138 should be smaller than the diameter of the lances 142 to avoid the movement of the lances out of their supported position within the tubes 138. The cross sectional shape of the hollow members may be of any convenient shape to accommodate one or more lances therein.

The improved lance drive 153 shown in FIG. 13 includes the same components as the device previously described except that it has been modified to deliver power to both rolls 154 and 156. The motor 158 connects to a gear train within the housing 160. The adjustable upper roll 154 and the lower roll 156 are both in driving connection with such rear train so that both rolls will impart motion to the lances. It should be noted that the rolls 154 and 156 are designed to drive three lances at the same time while the previously described drive unit was shown driving only two lances. Such drive units may be made to drive four or more of such lances.

Figure 15:
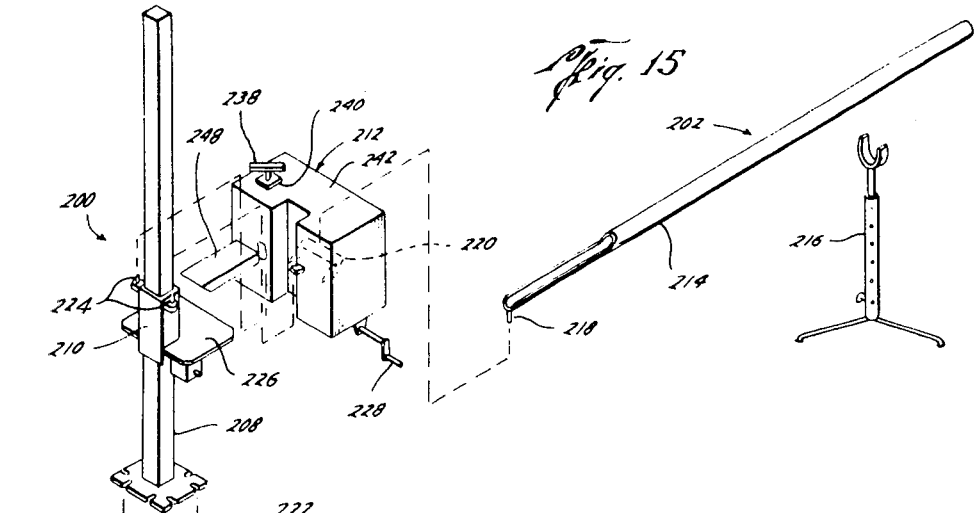
FIG. 15 is an exploded view of a modified form of lance driving device to illustrate its component parts and the relative simplicity of its assembly.

The modified lance driving and guiding device 200 and lance supporting device 202 illustrated in FIG. 15 are totally portable and comparatively easy to assemble and disassemble. The driving and guiding device 200 includes the base 204 in which the base carriage 206 is movably mounted. The base carriage 206 is adapted to receive the pedestal or column 208 on which is mounted the vertically movable carriage 210 and the guiding and driving unit 212 is adapted to be mounted on the carriage 210. The lance supporting device 202 includes the pipe 214 which is supported at one end by the stand 216, and at the other end of insertion of the pin 218 into a hole (not shown) in the support 220 on the driving unit 212.

The base 204 includes the jack 222 which functions to raise or lower one side of the base 204 to provide the desired positioning of column 208. Also jack 222 by extending to the rear of base 204 provides additional reaction support to allow the lances to be forced with considerable force through clogged and blocked tubes.

The column 208 is suitably secured to the base carriage 206. Carriage 210 is mounted on column 208 and includes the upwardly projecting pipe 224 and the table 226 on which the driving unit 212 is supported. The hand crank 228 on driving unit includes a clutching connection with the gearing in the carriage 210 which allows the vertical position of the driving unit 212 to be set by the hand crank 228.

The end of the pipe 214 supported on the driving unit 212 is open as shown to expose the lances entering the driving unit 212. The stand 216 is vertically adjustable so that the pipe 214 may be maintained substantially level at all vertical positions of the driving unit 212.

Figure 16:
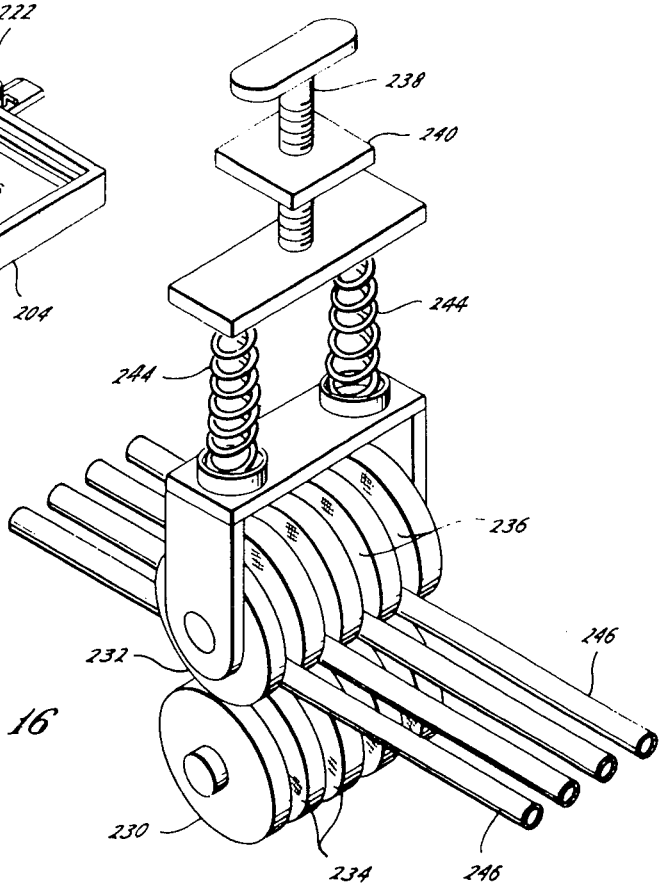
FIG. 16 is a perspective view of the lance drive rollers and the adjustable roller loading.

Since the function of the drive rollers is to impart sufficient force to the lances to allow them to be forced through clogged and blocked tubes, the rollers 230 and 232 are shown in FIG. 16 are provided with knurled grooves 234 and 236. An example of suitable knurling is provided in a 9/32 inch radius, 3/32 inch deep groove by a number 3K00 coarse knurling tool. The screw 238 which extends through the threaded plate 240 on the case 242 of driving unit 21 adjusts the force which the springs 244 exert to clamp the lances 246 between the rollers 230 and 232. In one unit, it was found that sufficient lance force could be developed by having a spring force on the rollers 230, 232 in the range from 52 pounds to 400 pounds. Such clamping force, together with the knurled engagement of the lances by the roller grooves, has allowed the development of lance forces of 270 pounds. In the rollers 230, 232 illustrated either one or both of the rollers may be driven as previously described.

Figure 17:
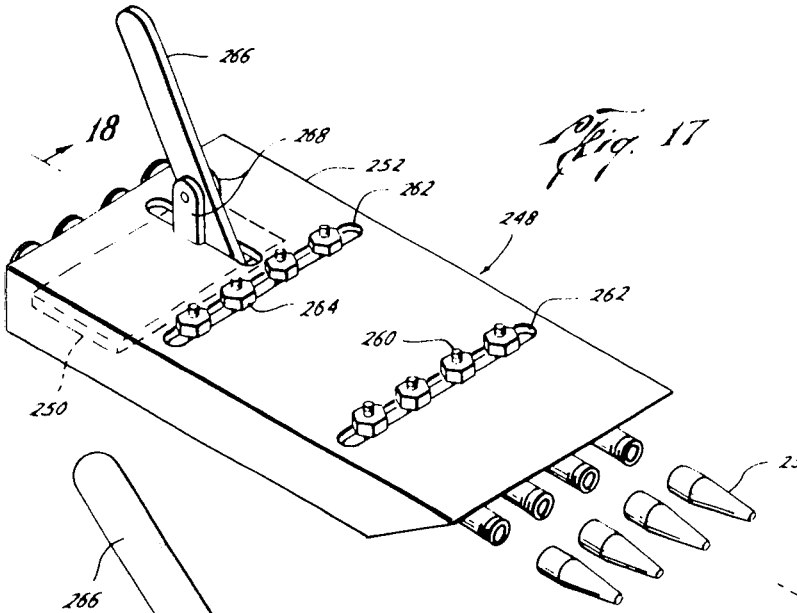
FIG. 17 is a perspective view of a modified lance guiding structure.
Figure 18:
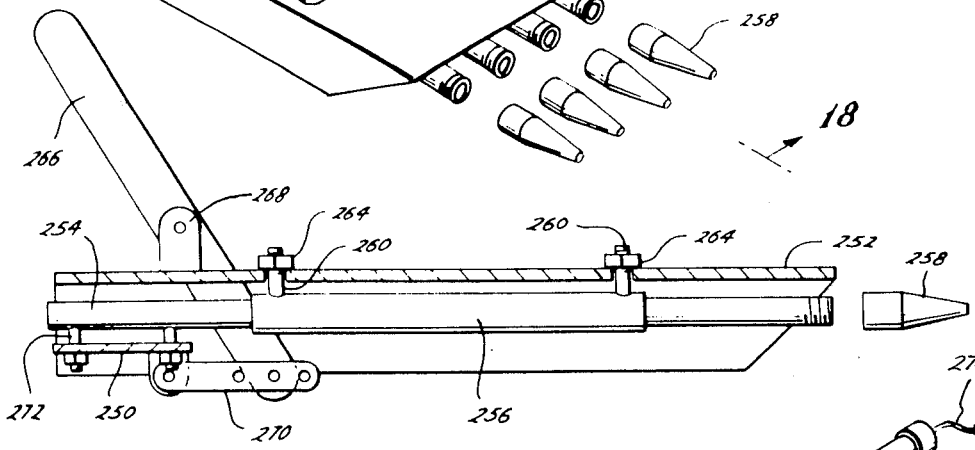
FIG. 18 is an elevation view of the lance guiding structure taken along line 18—18 in FIG. 17.
Figure 19:
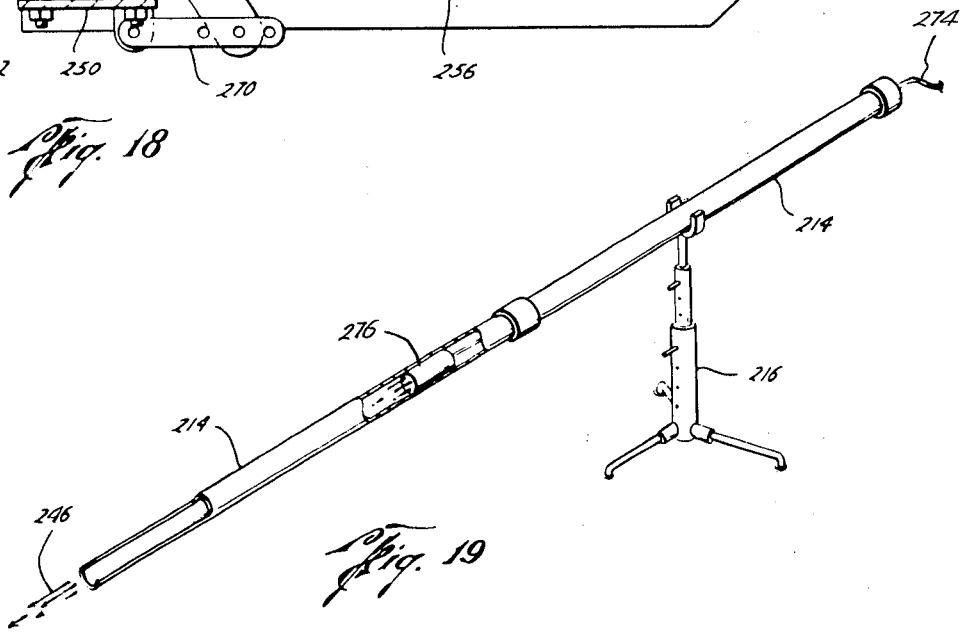
FIG. 19 is a perspective view of the modified lance support structure with portions broken away to show the lance water manifold connection.

A modified form of lance guiding device is illustrated in FIGS. 17 and 18 which has lateral adjustability of the lance spacing. The guiding device 248 includes the plate 250, the slotted hood 252, which is supported from the driving unit 212, the guide tubes 254, the guide sleeves 256, means for adjusting the lateral spacing of the guide sleeves, and the means for moving the guide tubes forward to engage their tapered tips 258 into the end of a tube bundle to be cleaned. The guide tubes provide support for the lances from a point adjacent to the drive rollers to the tubes being cleaned to assure that the lancers do not bend or buckle and to thereby assure that all of the force imparted to the lances by the drive rollers is exerted on the lance tips to force them through blocked or clogged tubes.

With hood 252 secured to the driving unit, the sleeves 256 are restrained against axial movement by the studs 260 which extend through the slots 262 in hood 252 and are secured in position by nuts 264. Slight loosening of nuts 264 allow lateral movement of the sleeves 256 and thus this mounting of the guide sleeve provides the means for adjusting the lateral spacing of the guide tubes 254 and accommodating the spacing of the lances 246 to the tube spacing to be cleaned.

The level 266 is pivotally mounted to the lugs 268 on hood 252 and is connected by link 270 to the plate 250 to which the guide tubes 254 are secured by the studs 272. Thus as the lever 266 is moved in a counter-clockwise direction in FIG. 18 the guide tubes 254 are moved forward (to the right) to have their tips 258 engage within the tubes being cleaned. Opposite movement of the level retracts the guide tubes 254.

The lances 246 are supplied with water as previously explained through the hose 274 and the manifold plug 276. The manifold plug 276 is adapted to slide freely within support pipe 214 and is provided with suitable passages communicating from the hose connection to the lances.

From the foregoing, it can be seen that the improved tube cleaning device of the present invention provides a drive for water jetting lances which is near the spray tip end of the lance when it is retracted. Also, the device provides for quick and simple alignment of the lances with tubes to be cleaned without having to remove the structure in which such tubes are positioned. The improved device also is easily disassembled and moved by men to render it portable in comparison to the tube cleaning devices of the prior art. Further, the device of the present invention provides sufficient driving force on the lances to allow them to be forced through blocked and clogged tubes, with the driving force being applied near the entrance to the tube being cleaned and with the lances being supported completely between the driving force and said tube entrance.

We claim:

1. A tube cleaning device, comprising:

at least one water jet lance, means for extending and retracting said lance, support means for said lance including an elongated slotted hollow member in which said lance is slidably positioned therein to prevent bending collapse of said lance when subjected to end loading, and means for supplying water under pressure to said lance, said water supply means including a manifold block having means therewith for distributing said pressurized water to said lance and a duct mounted with said manifold block and said lance for conducting said pressurized water therebetween, wherein said elongated slotted hollow member having a slot formed therein slidably receives said duct adjacent thereto said slot.

2. A tube cleaning device according to claim 1, wherein said support means further includes:

a tray for supporting said elongated slotted hollow member therewith.

3. The tube cleaning device according to claim 2, further including:

a carriage mounted for movement on said tray for supporting said manifold block for movement therewith.

4. A tube cleaning device, comprising:

a frame including opposing channel members adapted for alignment with the tubes of a heat exchanger or the like;

a tray mounted with said frame, said tray having a plurality of support tubes mounted therewith, said support tubes having slots extending longitudinally thereof;

a carriage mounted on said channels for movement along said channels;

a manifold mounted for movement with said carriage; and a plurality of water jet lances mounted in said support tubes and affixed to said manifold through a plurality of ducts which extend from said manifold through said slots into fluid connection with said lances whereby said lances are mounted for movement with respect to said tray and said support tubes.

* * * * *